United States Patent [19]

Fillmore

[11] 4,375,859

[45] Mar. 8, 1983

[54] CHILD-RESISTANT PACKAGE

[75] Inventor: William E. Fillmore, Toledo, Ohio

[73] Assignee: Owens-Illinois, Inc., Toledo, Ohio

[21] Appl. No.: 319,832

[22] Filed: Nov. 9, 1981

[51] Int. Cl.[3] ..... B65D 55/02; B65D 85/56; A61J 1/00

[52] U.S. Cl. ..... 215/223; 215/206; 215/224

[58] Field of Search ..... 215/206, 223, 224

[56] References Cited

U.S. PATENT DOCUMENTS

| | | | |
|---|---|---|---|
| 3,860,133 | 1/1975 | Boxer et al. | 215/206 |
| 3,871,662 | 3/1975 | Hepp et al. | 215/224 X |
| 3,980,194 | 9/1976 | Costa | 215/223 |
| 4,071,156 | 1/1978 | Lowe | 215/223 |

*Primary Examiner*—George T. Hall

*Attorney, Agent, or Firm*—John R. Nelson; M. E. Click; D. H. Wilson

[57] ABSTRACT

A child-resistant package comprising a container and a snap-on closure. The container has a neck finish including a first upper annular retaining bead and a second lower annular retaining bead spaced axially beneath the first annular bead. The first retaining bead has a notch therein and the second annular bead is continuous. An annular protective flange extends radially outwardly and is axially spaced below the second bead. The closure has a base and a peripheral skirt with a lifting tab on the outer surface thereof, a first radially inwardly extending locking lug on the inner surface thereof adjacent the external lifting tab, and at least one second radially inwardly extending locking lug located diametrically opposite from the lifting tab and axially below the plane of the first locking lug. When the closure is assembled to the finish, the first locking lug is located below the first retaining bead and the second locking lug is located beneath the second retaining bead, and when the closure is rotated to bring first locking lug into registry with the notch, the closure can be removed by upward force on the lifting tab. A stabilizing bead is provided diametrically opposite the lower or second locking lug and cooperates with the lower retaining bead to stabilize the rotation of the closure and prevent any upward movement of the closure when the locking lug is oriented so that it is in register with the notch in the upper or first retaining bead.

18 Claims, 19 Drawing Figures

CHILD-RESISTANT PACKAGE

This invention relates to child-resistant packages.

BACKGROUND AND SUMMARY OF THE INVENTION

It has been recognized that child-resistant packages are necessary in the handling of pharmaceuticals and the like to deter children from opening the package.

The present invention is directed to a package utilizing an orientable snap-on closure which will provide a low-cost package system that is child-resistant and will provide moisture vapor transmission resistance, in one form.

In accordance with the invention, the child-resistant package comprises a container and a snap-on closure. The container has a neck finish including a first upper annular retaining bead and a second lower annular retaining bead spaced axially beneath the first annular bead. The first retaining bead has a notch therein and the second retaining bead is continuous. An annular protective flange extends radially outwardly and is axially spaced below the second bead. The closure has a base and a peripheral skirt, a lifting tab on the outer surface thereof, a first radially inwardly extending lug on the inner surface thereof adjacent the external lifting tab and at least one second radially inwardly extending locking lug located generally diametrically opposite from the lifting tab and axially below the plane of the first locking lug. When the closure is assembled to the finish, the first locking lug is located below the first retaining bead and the second locking lug is located beneath the second retaining bead, and when the closure is rotated to bring first locking lug into registry with the notch, the closure can be removed by upward force on the lifting tab.

A stabilizing bead is provided diametrically opposite the lower or second locking lug and cooperates with the lower retaining bead to stabilize the rotation of the closure and prevent any upward movement of the closure when the locking lug is oriented so that it is in register with the notch in the upper or first retaining bead.

DESCRIPTION

Figure 1:
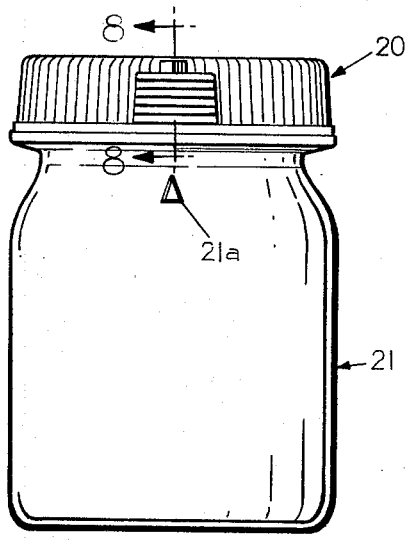
FIG. 1 is an elevational view of a child-resistant package embodying the invention.

Referring to FIG. 1, the child-resistant package embodying the invention comprises a closure 20 and a container 21. The closure 20 is preferably made of organic plastic material such as high density polyethylene and the container 21 is preferably made of organic plastic material such as high density polyethylene but also may be made of glass.

Figure 2:
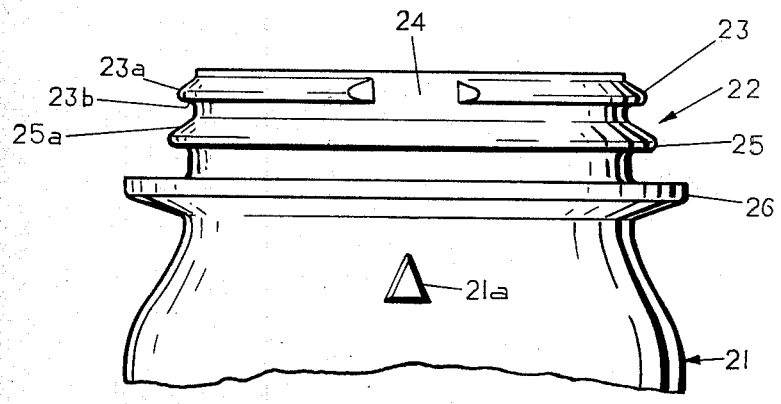
FIG. 2 is a fragmentary front elevational view of the upper portion of the container with the closure removed.
Figure 3:
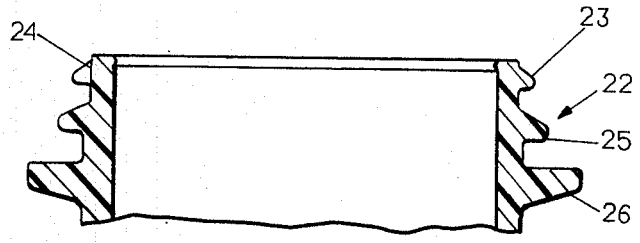
FIG. 3 is a sectional view of the container taken along the line 8—8 in FIG. 1 with the closure removed.
Figure 4:
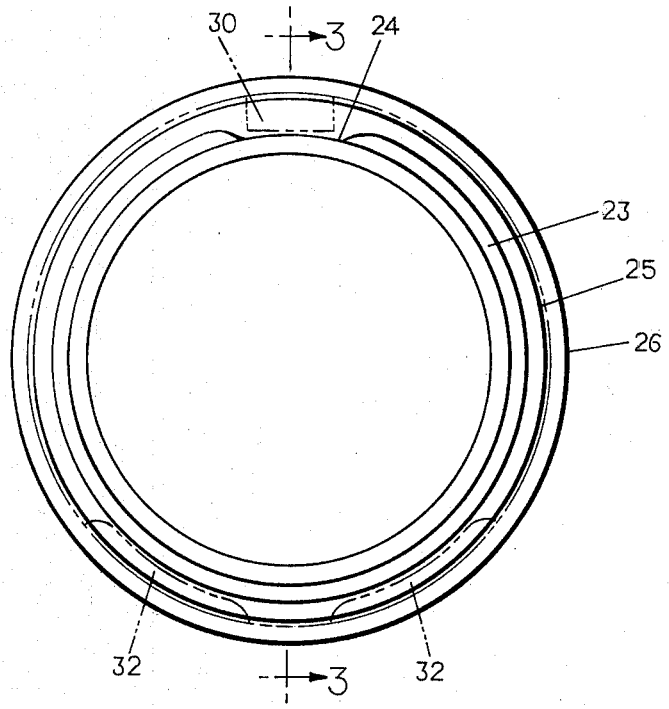
FIG. 4 is a plan view of the container.

In accordance with the invention, the container 21 has a neck finish 22 formed with a first or upper annular retaining bead 23 having a notch 24 in its periphery and a second or lower continuous annular bead 25 (FIGS. 2–4). The container is further formed with a protective flange 26 extending radially outwardly from and axially spaced below the second retaining bead 25 and an indicia **21*a* on the neck aligned with notch 24. The outer diameter of the upper retaining bead 23 is less than the diameter of the lower retaining bead 25. Each bead 23, 25 has inclined upper surfaces 23*a*, 25*a* to facilitate snap action assembly. The upper bead 23 has a lower generally horizontal or radial surface 23*b*** to facilitate locking.

Figure 5:
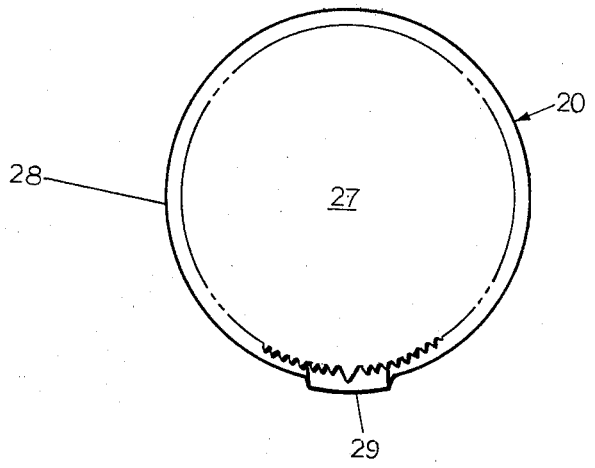
FIG. 5 is a top plan view of the closure.
Figure 6:
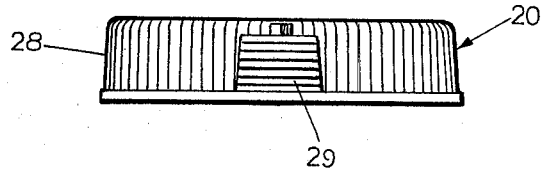
FIG. 6 is a front elevational view of the closure.
Figure 7:
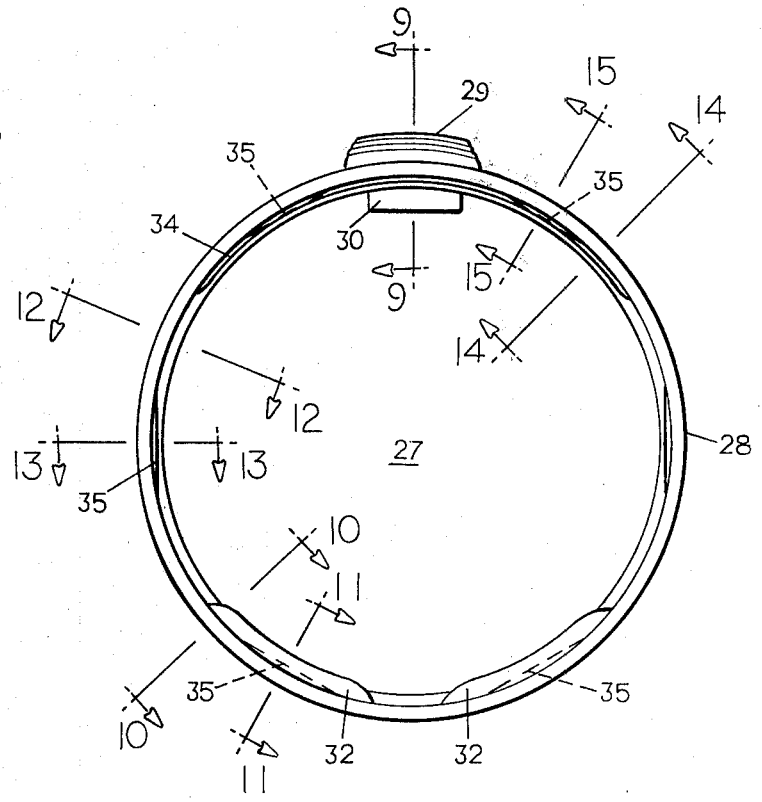
FIG. 7 is a bottom plan view of the closure.
Figure 8:
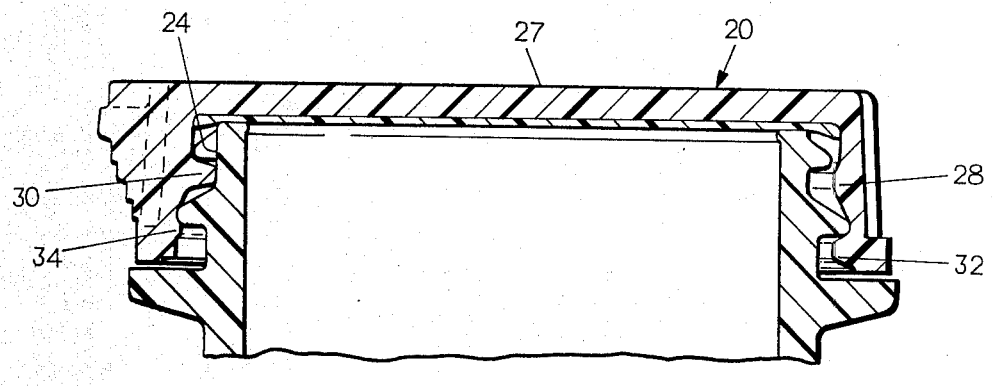
FIG. 8 is a fragmentary vertical sectional view taken along the line 8—8 in FIG. 1 showing the closure applied to the container.
Figure 9:
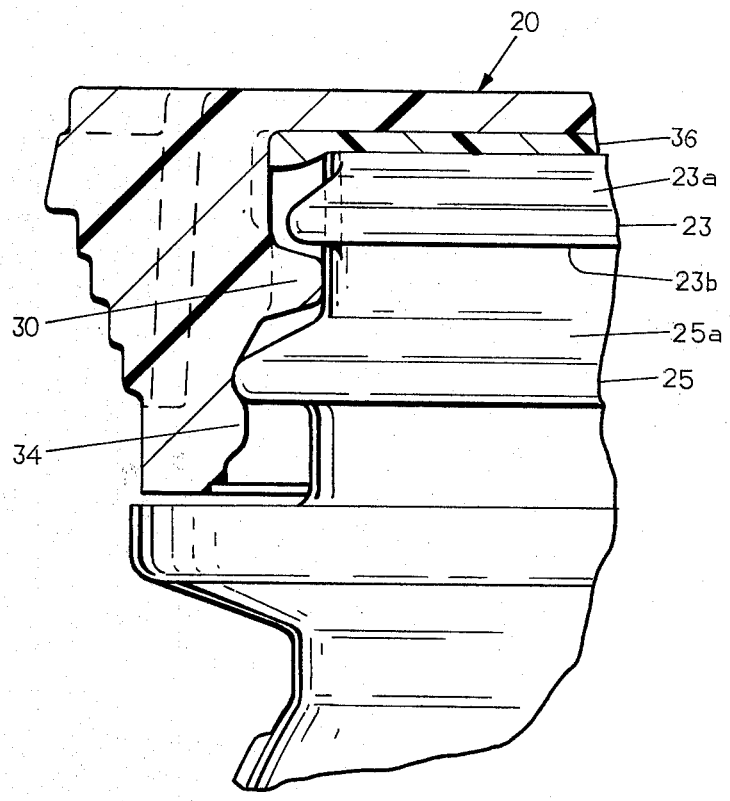
FIG. 9 is a fragmentary sectional view of the closure on an enlarged scale taken along the line 9—9 in FIG. 7 showing the closure assembled on the container.

Referring to FIGS. 5–7, the closure 20 includes a flat top or panel portion 27 and a peripheral skirt portion 28. An external lifting tab 29 is provided on the outer surface of the skirt 28 and a first radially inwardly extending locking lug 30 having an arcuate extent substantially equal to or less than the arcuate extent of the notch 24 is provided on the inner surface of the skirt 28 adjacent the lifting tab 29. The first lug 30 is provided axially on the skirt in a position such that it extends beneath the first retaining bead 23 when the closure is in position on the container as shown in FIGS. 8, 9 and preferably does not control bead 23.

Figure 10:
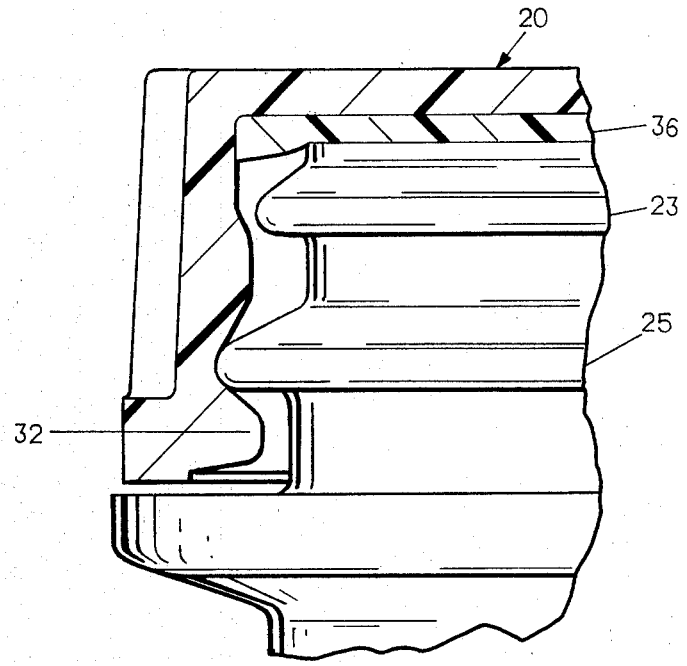
FIG. 10 is a fragmentary sectional view of the closure on an enlarged scale taken along the line 10—10 in FIG. 7 showing the closure assembled on the container.
Figure 11:
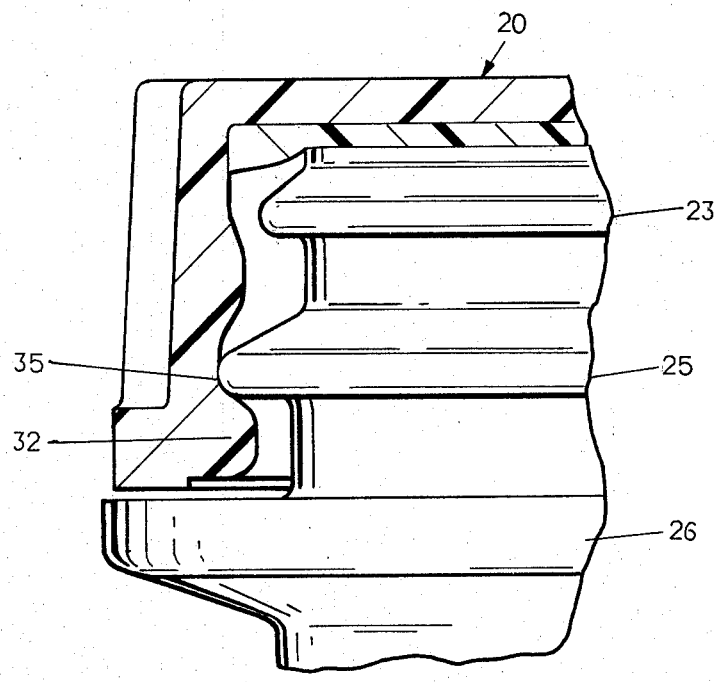
FIG. 11 is a fragmentary sectional view of the closure on an enlarged scale taken along the line 11—11 in FIG. 7 showing the closure assembled on the container.
Figure 12:
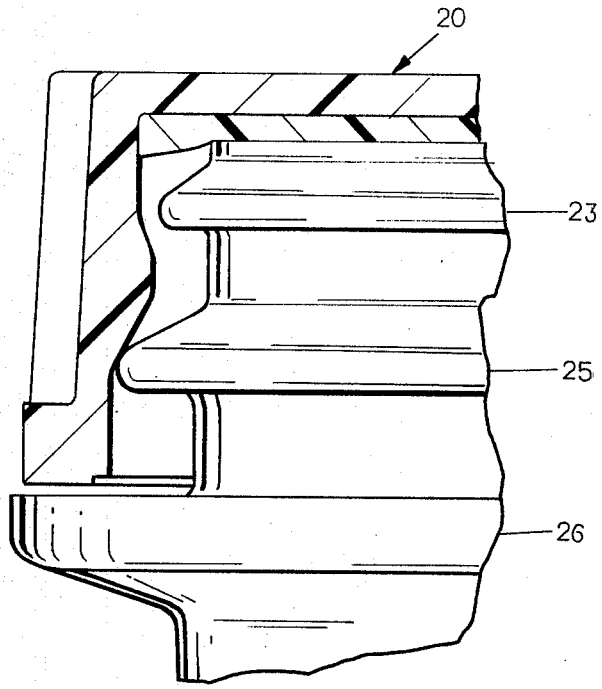
FIG. 12 is a fragmentary sectional view of the closure on an enlarged scale taken along the line 12—12 in FIG. 7 showing the closure assembled on the container.
Figure 13:
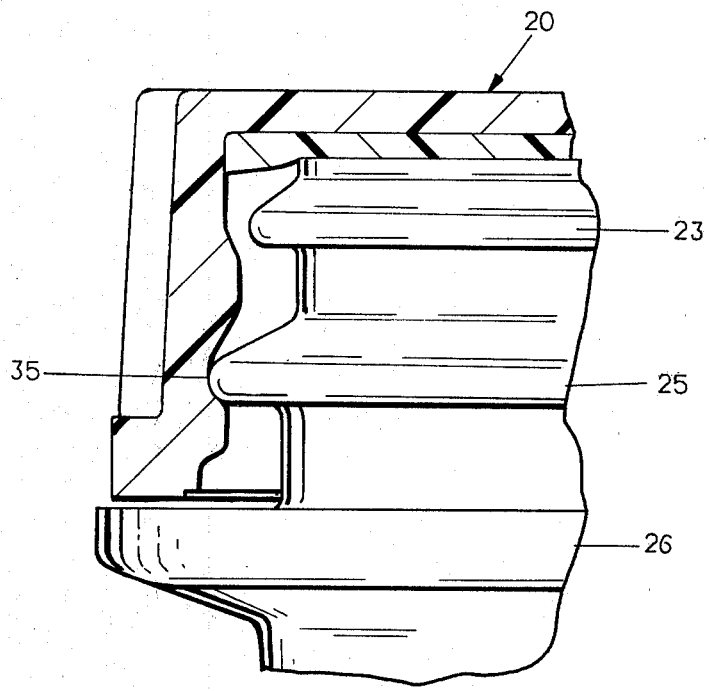
FIG. 13 is a fragmentary sectional view of the closure on an enlarged scale taken along the line 13—13 in FIG. 7 showing the closure assembled on the container.
Figure 14:
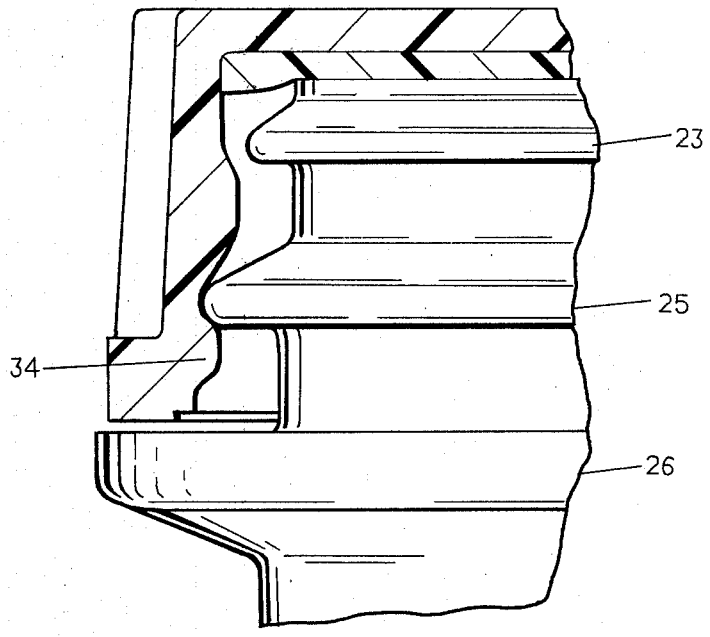
FIG. 14 is a fragmentary sectional view of the closure on an enlarged scale taken along the line 14—14 in FIG. 7 showing the closure assembled on the container.
Figure 15:
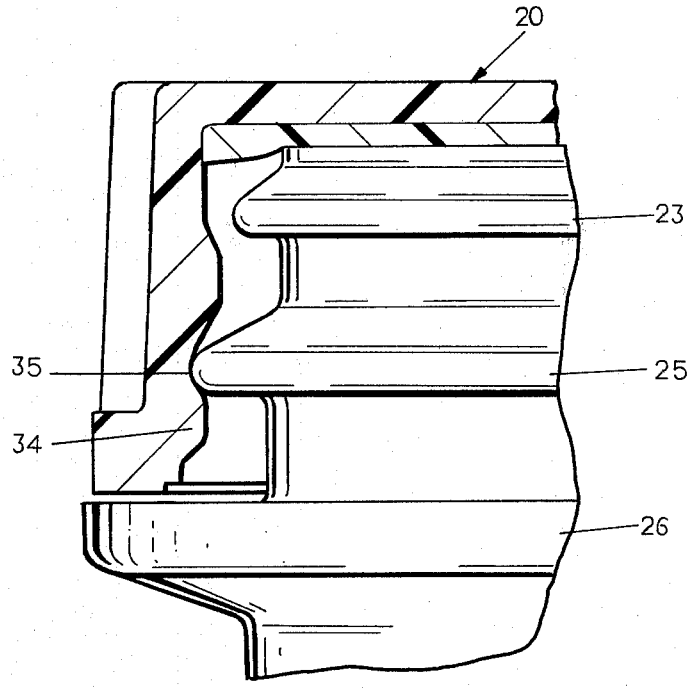
FIG. 15 is a fragmentary sectional view on an enlarged scale of the closure taken along the line 15—15 in FIG. 7 showing the closure on the container.

The skirt 28 is further formed with at least one radially inwardly extending locking lug 32 generally diametrically opposite to first locking lug 30. Lug 32 is axially positioned along the skirt near the lower edge so that it will engage below the second retaining bead 25 when the closure is on the finish as shown in FIGS. 10, 11. Preferably, a plurality of lugs 32 are provided, shown as a pair of lugs, and each having a greater arcuate extent than lug 30.

The skirt is further formed with at least one integral arcuate stabilizing head 34 opposite the longer lugs 32, and below the first locking lug which is adapted to engage beneath the second retaining bead 25 and stabilize the rotation of the closure so that it will rotate evenly.

The diametral distance between the stabilizing bead 34 and the second locking lugs 32 is greater than the diameter of the upper or first retaining bead 23 on the finish of the container. The stabilizing bead 34 maintains contact with the second retaining bead 25 even when the first locking lug 30 is oriented into register with the notch 24, thereby preventing upward movement of the closure 20. Thus, the stabilizing bead 34 cooperating with the lower retaining bead 25 functions to prevent any axial motion that might suggest to a child that the closure is in a position for removal.

As a result of the construction, there is a substantial clearance between the inner surface of the skirt 28 of the closure 20 and the upper retaining bead 23 and a snug circumferential contact between the inner surface of the skirt 28 and the lower retaining bead 25.

In order to permit less stringent manufacturing tolerances, the closure includes a plurality of tangential flat-faced facets 35 in the skirt of the closure adapted to frictionally engage the lower retaining bead 25 and thereby provide maximum closure retention over the tolerances of the closure and finish (FIGS. 7, 11, 13, 15). The facets 35 thus prevent lateral or radial movement of the closure relative to the finish so that the engagement with the lower retaining bead 25 is maintained even through there are variations in the dimensions of the closure and finish in the manufacture thereof.

In order to provide moisture vapor transmission resistance to the package, a liner 36 of expanded plastic material is preferably positioned in the top of the closure between the top wall 27 and the upper end of the finish.

The closure 20 can be applied to the finish in any oriented position of the closure relative to the finish merely by snapping the closure onto the finish. By having the diameter of the upper retaining bead 23 smaller than the diameter of the lower retaining bead 25, and the diametral distance between the lower locking lugs 32 and the stabilizing segment 34 being greater than the diameter of the upper retaining bead 23, the lower retaining bead 25 and stabilizing segment 34 are prevented from engaging the upper bead 23 thereby preventing inadvertent unlocked attachment when the closure is partially applied.

Figure 16:
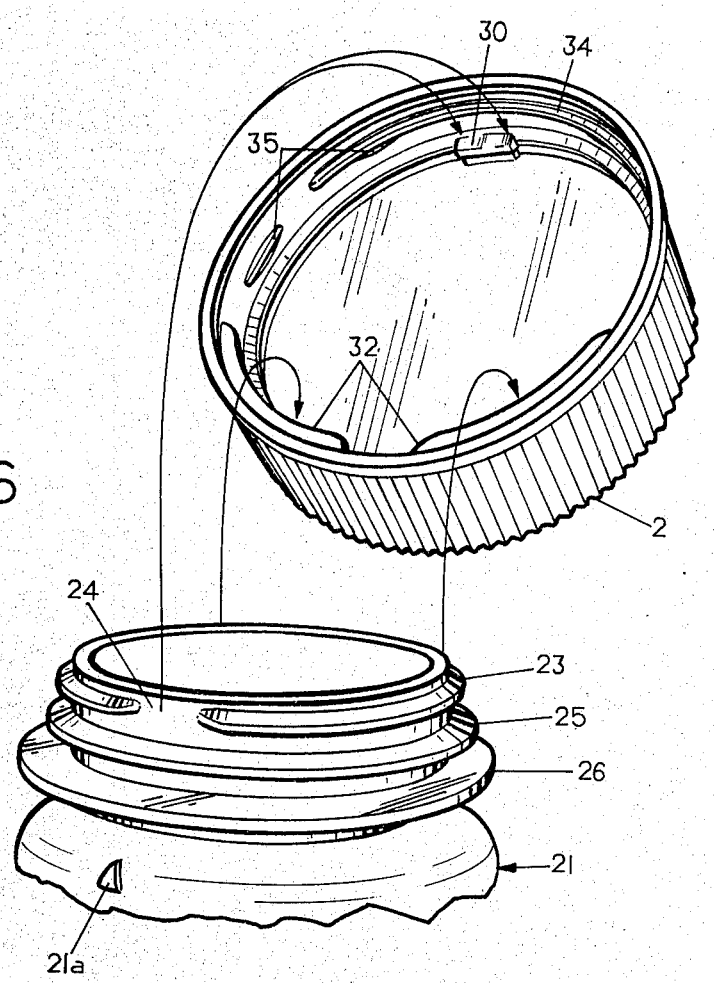
FIG. 16 is a diagrammatic view showing the general relationship of a child-resistant package including the closure and finish of the container.
Figure 17:
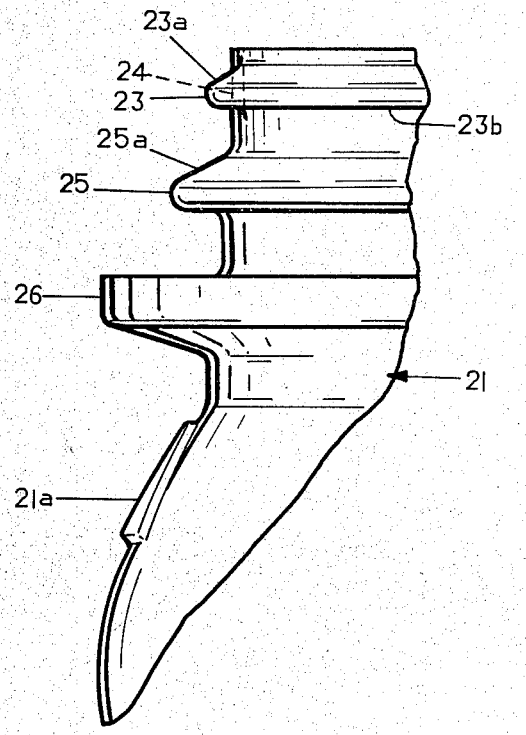
FIG. 17 is a fragmentary vertical side elevational view of the upper end of the container.

When it is desired to remove the closure, it is rotated bringing the external tab 29 into registry with indicia 35 on the exterior of the container and then an upward force is applied to the tab 29 permitting the lug 30 to be moved freely through the notch 24 and the closure to be removed by a tipping movement (FIG. 16).

The use of upper and lower retaining beads 23, 25 on the finish with two lugs 30 and 32 on the closure at different axial or elevational positions within the closure combined with the stabilizing segment 34 causes the closure to rotate evenly without noticeable elevation of the closure when the closure is placed in the opening position as when the closure is brought into registry with the indicia inadvertently, for example by a child. This feature is especially effective when a liner is used since the liner tends to lift the closure firmly against the retaining beads.

The use of two retaining beads on the finish, one of which has a notch, causes the closure to rotate smoothly even though the finish may be distorted due to tolerances. The use of the facets 35 within the closure insures that the closure is prevented from moving laterally with respect to the finish to thereby provide proper interference fit with the annular lower bead under most variations of tolerances of the closure of finish.

When the closure is on the container, the protective flange 26 extends radially outwardly below the lower edge of skirt 28 of closure 20 and in close proximity thereto to prevent access to the lower edge of the skirt so that the skirt can not be pried away from the closure.

Figure 18:
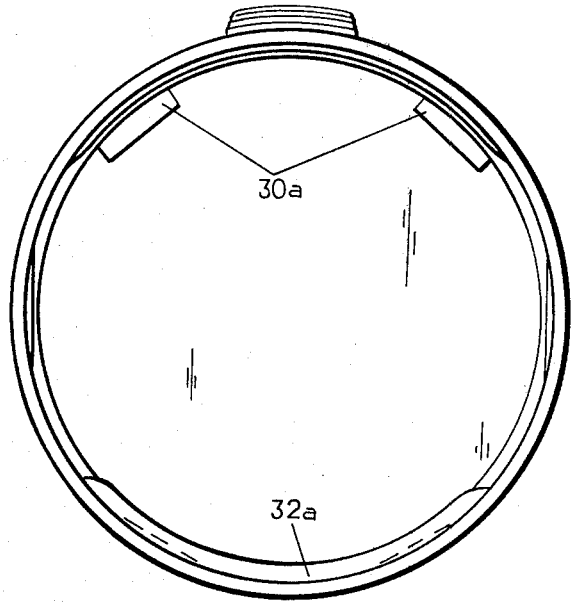
FIG. 18 is a bottom plan view of a modified form of closure.
Figure 19:
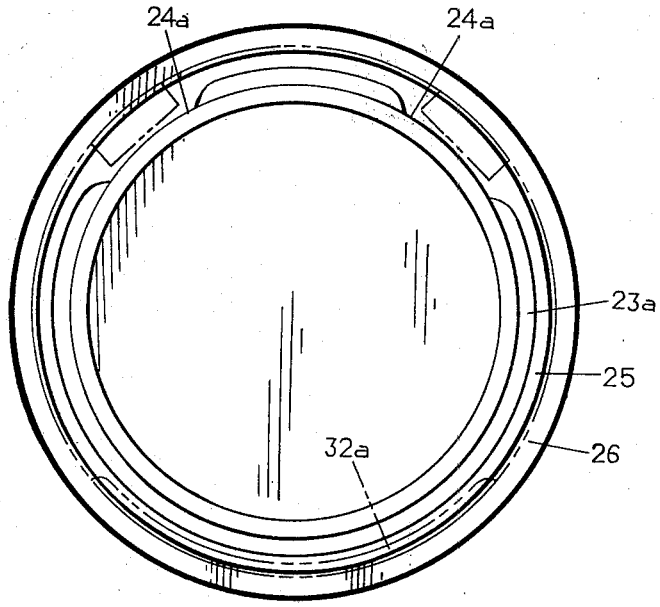
FIG. 19 is a top plan view of a container used with the closure shown in FIG. 18.

In a modified form of the invention, shown in FIGS. 18, 19 the closure comprises a pair of locking lugs **30*a* at the upper level adapted to be registered with a pair of notches 24*a* on the container. A single locking lug 32*a* is provided for engagement with lower retaining bead 25**. It can thus be seen that other arrangements of locking lugs can be provided at the upper level to produce the desired locking in combination with one or more opposed locking lugs at the lower level. In all other respects the closure and container are the same, corresponding reference numerals being used for clarity.

I claim:

1. A child-resistant package with a snap-on closure comprising a container having a neck finish, said neck finish including a first upper annular retaining bead, a second lower annular retaining bead spaced axially beneath the first annular bead and a flange extending radially outwardly and being axially spaced below the second bead, said first annular bead having a notch therein, said second annular bead being continuous, a closure having a top and a peripheral skirt, said skirt having a lifting tab on the outer surface thereof, a first radially inwardly extending locking lug on the inner surface thereof adjacent the external lifting tab, said skirt having at least one second radially inwardly extending locking lug located generally diametrically opposite from the lifting tab and axially below the plane of the first locking lug, such that when the closure is assembled to the finish, the first locking lug is located below the first retaining bead and the second locking lug is located beneath the second retaining bead, and when the first locking lug is brought into registry with the notch, the closure can be removed by upward force on the lifting tab.

2. The child-resistant package set forth in claim 1 wherein said skirt includes at least one stabilizing segment spaced below the first locking lug and extending radially inwardly in the plane of the second lug so that it is positioned for engagement below the second retaining bead of the container to facilitate rotation of the closure relative to the container.

3. The child-resistant package set forth in claim 1 wherein said first retaining bead on the container has a smaller diameter than the diameter of the second retaining bead on the container.

4. The child-resistant package set forth in claim 1 wherein said skirt includes a plurality of flat facets on the inner surface of the skirt for engaging the second retaining bead of the container to provide radial closure retention over the tolerances of the closure and finish.

5. The child-resistant package set forth in claim 1 including a liner of resilient material interposed between the bottom of the closure and the top of the container.

6. The child-resistant package set forth in claim 1 wherein said first locking lug is normally out of contact with the first retaining bead when the closure is assembled on the finish of the container.

7. The child-resistant package set forth in claim 1 wherein said skirt of said closure includes a pair of stabilizing segments extending circumferentially and spaced axially below the first locking lug to facilitate rotation of said closure relative to said container.

8. The child-resistant package set forth in claim 1 wherein said closure is made of organic plastic material and said panel and skirt are so constructed and arranged to flex and permit the closure to be snapped on to the finish.

9. A child-resistant package with a snap-on closure comprising a container having a neck finish, said neck finish including a first upper annular retaining bead, a second lower annular retaining bead spaced axially beneath the first annular bead and a flange extending radially outwardly and being axially spaced below the second bead, said first annular bead having a notch therein, said second annular bead being continuous, a closure of organic plastic material having a top and a peripheral skirt, said skirt having a lifting tab on the outer surface thereof, a first radially inwardly extending locking lug on the inner surface thereof adjacent the external lifting tab, said skirt having a plurality of second radially inwardly extending locking lugs located diametrically opposite from the lifting tab and axially below the plane of the first locking lug, such that when the closure is assembled to the finish, the first locking lug is located below the first retaining bead and the second locking lugs are located beneath the second retaining bead, and when the first locking lug is brought into registry with the notch, the closure can be removed by upward force on the lifting lug, said skirt including a stabilizing segment spaced below the first locking lug and extending radially inwardly in the plane of the second lug so that it is positioned for engagement below the second retaining bead of the container to facilitate rotation of the closure relative to the container, said first retaining bead on the container having a smaller diameter than the diameter of the second retaining bead.

10. The child-resistant package set forth in claim 9 wherein said skirt includes a plurality of flat facets on the inner surface of the skirt for engaging the second retaining bead of the container to provide radial closure retention over the tolerances of the closure and finish.

11. The child-resistant package set forth in claim 10 including a liner of resilient material interposed between the bottom of the closure and the top of the container.

12. The child-resistant package set forth in claim 10 wherein said first locking lug is normally out of contact with the first retaining bead when the closure is assembled on the finish of the container.

13. The child-resistant package set forth in claim 9 wherein the outer diameter of said upper retaining bead is less than the outer diameter of said lower retaining bead.

14. The child-resistant package set forth in claim 13 wherein there is substantial clearance between the inner surface of said skirt of said closure and the upper retaining bead and snug circumferential contact between the inner surface of said skirt and said lower retaining bead.

15. A child-resistant package with a snap-on closure comprising a container having a neck finish, said neck finish including a first upper annular retaining bead, a second lower annular retaining bead spaced axially beneath the first annular bead and a flange extending radially outwardly and being axially spaced below the second bead, said first annular bead having a notch therein, said second annular bead being continuous, a closure having a top and a peripheral skirt, said skirt having a lifting tab on the outer surface thereof, a first radially inwardly extending locking lug on the inner surface thereof adjacent the external lifting tab, said skirt having at least one second radially inwardly extending locking lug located generally diametrically opposite from the lifting tab and axially below the plane of the first locking lug, the outer diameter of said upper retaining bead being less than the diameter of the lower retaining bead such that there is substantial circumferential clearance between the inner surface of said skirt of said closure and snug circumferential contact between the inner surface of said skirt and said lower retaining bead, such that when the closure is assembled to the finish, the first locking lug is located below the first retaining bead and the second locking lug is located beneath the second retaining bead, and when the first locking lug is brought into registry with the notch, the closure can be removed by upward force on the lifting tab.

16. The child-resistant package set forth in claim 15 wherein said skirt includes at least one stabilizing segment spaced below the first locking lug and extending radially inwardly in the plane of the second lug so that it is positioned for engagement below the second retaining bead of the container to facilitate rotation of the closure relative to the container.

17. The child-resistant package set forth in claim 16 including a liner of resilient material interposed between the bottom of the closure and the top of the container.

18. The child-resistant package set forth in claim 15 wherein said protective flange extends radially outwardly beneath and in close proximity to the lower edge of said skirt.

* * * * *

UNITED STATES PATENT AND TRADEMARK OFFICE

CERTIFICATE OF CORRECTION

PATENT NO. : 4,375,859

DATED : March 8, 1983

INVENTOR(S) : William E. Fillmore

It is certified that error appears in the above-identified patent and that said Letters Patent are hereby corrected as shown below:

Col. 6, line 22 (Claim 15, line 7) before "flange" insert --protective--.

Signed and Sealed this

*Twenty-fourth* Day of *May 1983*

[SEAL]

*Attest:*

DONALD J. QUIGG

*Attesting Officer*

*Acting Commissioner of Patents and Trademarks*